US005528212A

United States Patent [19]

Challenger et al.

[11] Patent Number: 5,528,212

[45] Date of Patent: Jun. 18, 1996

[54] METHOD AND APPARATUS FOR CONTROL OF A MAGNETIC STRUCTURE

[75] Inventors: Michael P. Challenger; Arthur S. Valla, both of Bothell, Wash.

[73] Assignee: STI Optronics, Inc., Bellevue, Wash.

[21] Appl. No.: 402,994

[22] Filed: Mar. 9, 1995

[51] Int. Cl.[6] ..... H01F 3/00

[52] U.S. Cl. ..... 335/298; 335/212; 335/306

[58] Field of Search ..... 335/298, 284, 335/212, 287, 296, 297, 302–306; 372/2, 9, 37; 315/5.34, 5.35; 324/318–320

[56] References Cited

U.S. PATENT DOCUMENTS 4,937,545 6/1990 Chaillout et al. ..... 335/298

5,420,556 5/1995 Okazaki ..... 335/212

5,424,703 6/1995 Blume, Jr. ..... 335/284

5,467,769 11/1995 Yoshino et al. ..... 128/653.2

*Primary Examiner*—Gerald P. Tolin

*Assistant Examiner*—Raymond M. Barreva

*Attorney, Agent, or Firm*—Robert M. Storwick

[57] ABSTRACT

A method and apparatus for independently adjusting the spacing between opposing magnet arrays in charged particle based light sources. Adjustment mechanisms between each of the magnet arrays and the supporting structure allow the gap between the two magnet arrays to be independently adjusted. In addition, spherical bearings in the linkages to the magnet arrays permit the transverse angular orientation of the magnet arrays to also be adjusted. The opposing magnet arrays can be supported above the ground by the structural support.

37 Claims, 3 Drawing Sheets

METHOD AND APPARATUS FOR CONTROL OF A MAGNETIC STRUCTURE

This invention was made with Government support under Contract No. ANL-31162401 awarded by the Department of Energy. The Government has certain rights in this invention.

TECHNICAL FIELD

The present invention relates to methods and apparatus for controlling magnetic fields, and more particularly, for adjusting the spacing of magnetic structures.

BACKGROUND OF THE INVENTION

Charged particle based sources, such as synchrotron radiation facilities and free electron lasers (FELs), typically require the use of a periodic magnetic field to control the path of the charged particle beam for photon emission. Generally, the magnetic field is supplied by two opposing arrays of magnets that are placed around the beam path. The magnets are separated by a gap in which the characteristics of the magnetic field are carefully controlled. Certain characteristics of the magnetic field require that the gap between the structures be changed so that there may be a difference in the gap dimension from one end of the structure pair to the other. It is important that this tapering not induce any additional stresses or constraints in the support structure of the magnet arrays or any mechanism for controlling the movement of the magnet arrays. It is also important that the tapering does not induce motion of the magnet structures in any more than one direction. Generally, the motion being described to change the gap is provided by conventional stepper or servo motors that drive lifting screws attached to the magnetic structures.

The ability of a magnetic structure motion control system to tolerate extreme gap taper without damage to the structure is of paramount importance. This is especially so because the provision of a physical taper limiting mechanism within the motion control system is generally considered to be neither reliable nor cost effective.

It is also important to be able to adjust the initial relative angular orientations of the two magnetic structures and then to maintain that angular relationship during any subsequent motion of the two structures.

SUMMARY OF THE INVENTION

According to one aspect, the invention is an apparatus for adjusting the spacing of the elements of a magnetic structure that includes a first array of magnets and a second array of magnets. The first and second arrays of magnets each have a first end and a second end, and the arrays of magnets are arranged on first and second sides of a first plane. The first ends of the first and second arrays of magnets are aligned with a first side of a second plane that is perpendicular to the first plane, and the first and second arrays of magnets extend away from the first side of the second plane.

The apparatus comprises a first spacing adjuster and a second spacing adjuster. The first spacing adjuster is connected between the first ends of the first and second arrays of magnets and extends substantially perpendicularly to the first plane. The second spacing adjuster is connected between the second ends of the first and second arrays of magnets and extends substantially perpendicularly to the first plane. The first spacing adjuster is adapted to adjust the spacing between the first ends of the first and second arrays of magnets in a first direction perpendicular to the first plane. Also, the second spacing adjuster is adapted to adjust the spacing between the second ends of the first and second arrays of magnets in a second direction perpendicular to the first plane. In accordance with this arrangement, the spatial relationships between the first ends of the first and second arrays of magnets and between the second ends of the first and second arrays of magnets are independently adjustable.

In accordance with a second aspect, the invention is a method for adjusting the spacing of the elements of a magnetic structure that includes a first array of magnets and a second array of magnets. The first and second arrays of magnets each have a first end and a second end, and are arranged on first and second sides of a first plane. The first ends of the first and second arrays of magnets are aligned with a first side of a second plane that is perpendicular to the first plane. The first and second arrays of magnets extend away from the first side of the second plane.

The method includes the step of a) connecting a first spacing adjuster between the first ends of the first and second arrays of magnets, where the first spacing adjuster extends substantially perpendicularly to the first plane. The method also includes the step of b) connecting a second spacing adjuster between the second ends of the first and second arrays of magnets, where the second spacing adjuster extends substantially perpendicularly to the first plane. The first spacing adjuster is adapted to adjust the spacing between the first ends of the first and second arrays of magnets in a first direction perpendicular to the first plane. Also, the second spacing adjuster is adapted to adjust the spacing between the second ends of the first and second arrays of magnets in a second direction perpendicular to the first plane. In accordance with the steps of the invention, the spatial relationships between the first ends of the first and second arrays of magnets and between the second ends of the first and second arrays of magnets are independently adjustable.

DETAILED DESCRIPTION OF THE PREFERRED EMBODIMENT OF THE INVENTION

Figure 1:
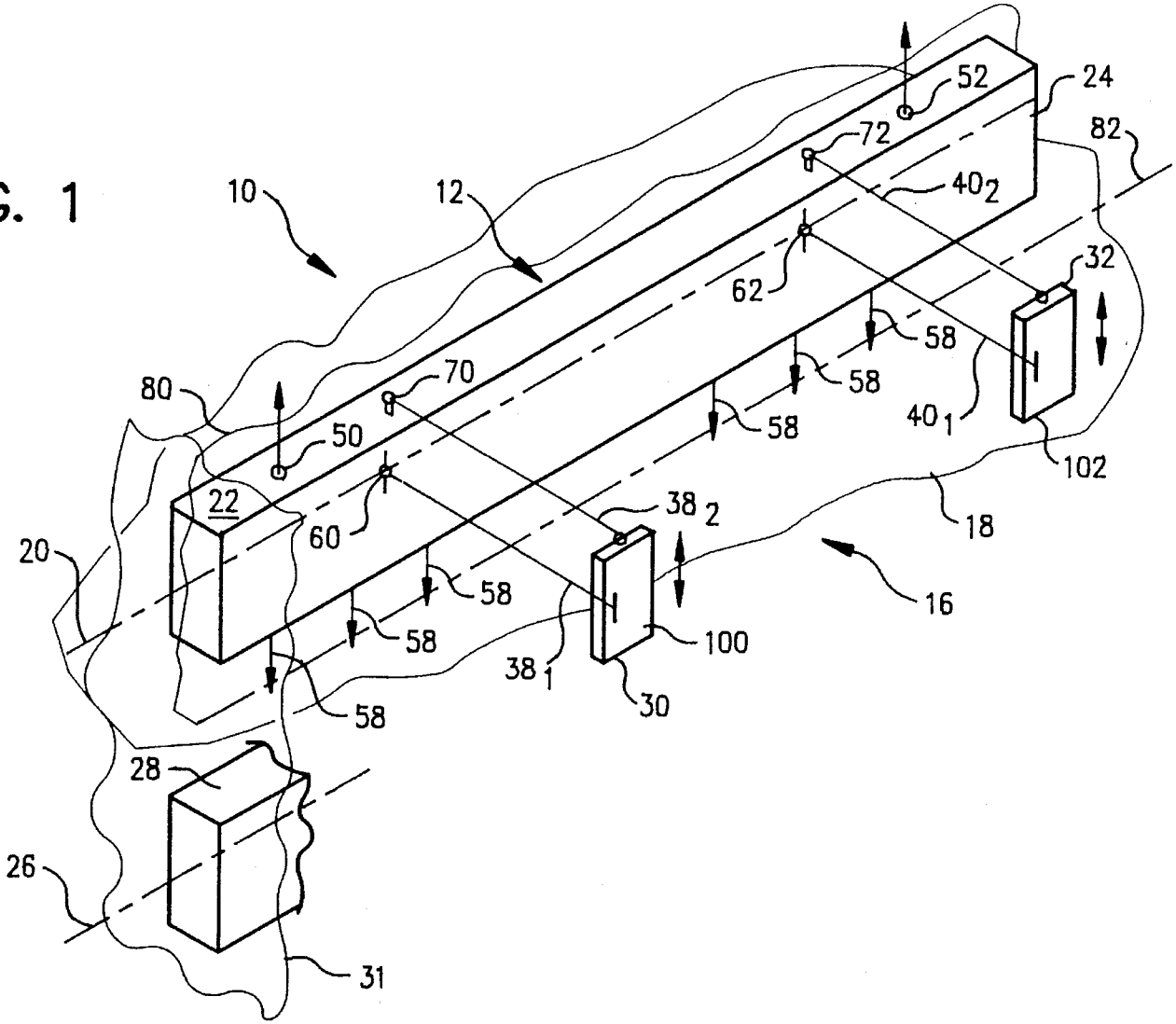
FIG. 1 is a perspective view of the preferred embodiment of the invention.
Figure 2:
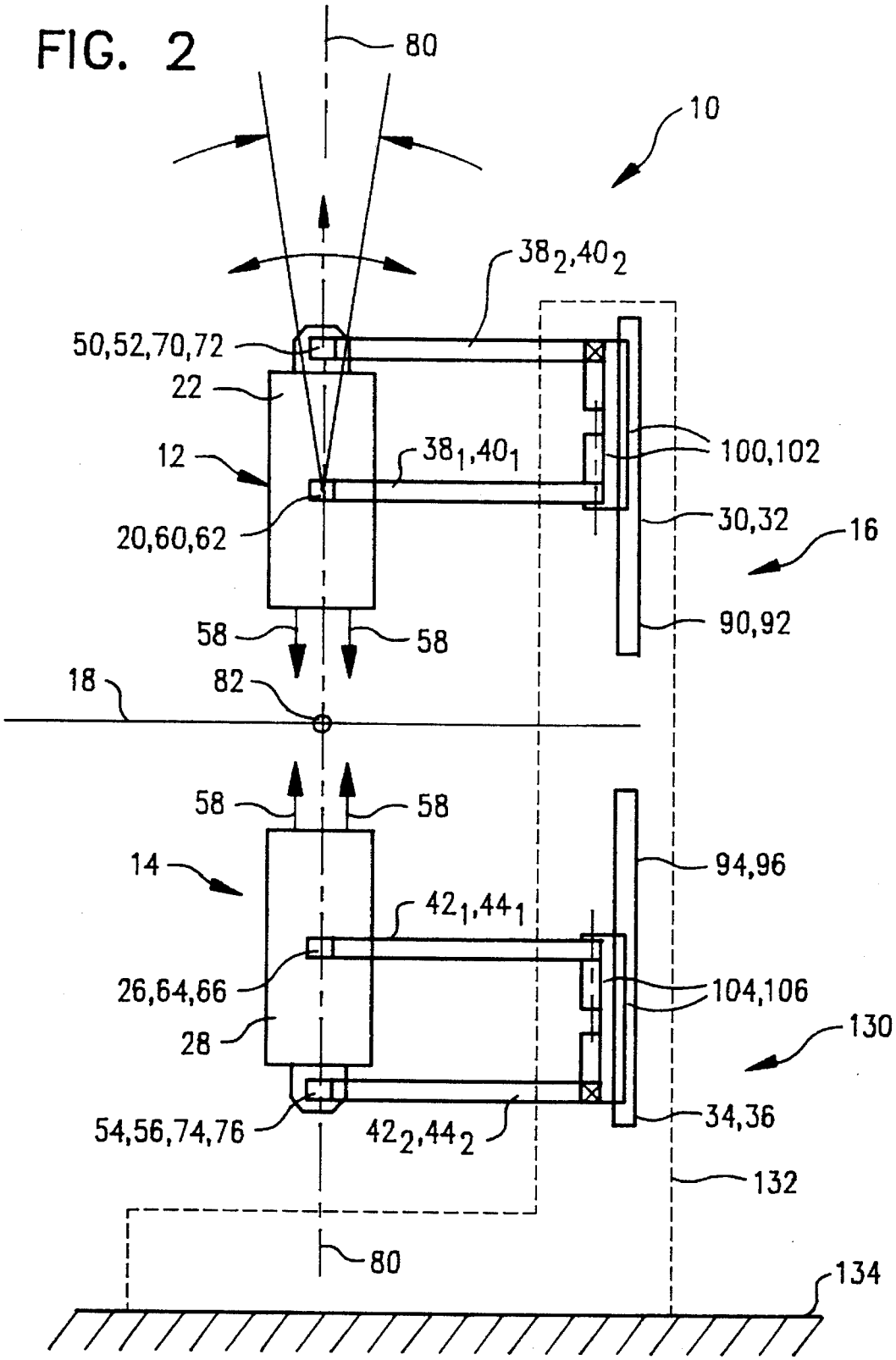
FIG. 2 is an elevation view of the preferred embodiment of the invention, taken in the longitudinal direction along the preferred embodiment.
Figure 3A:
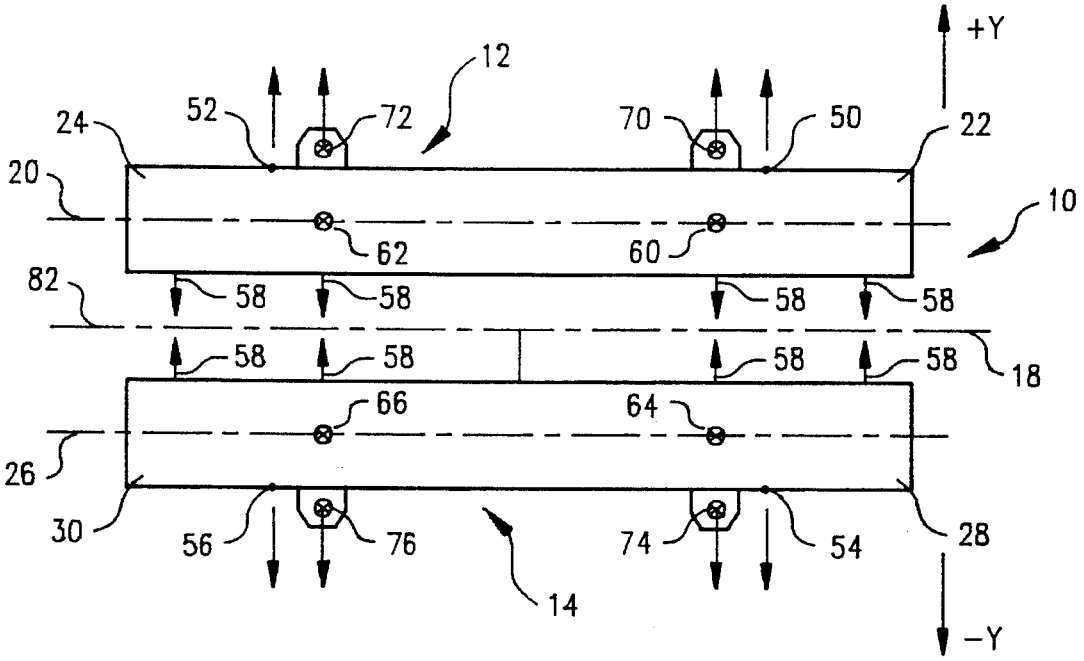
FIG. 3A is an elevation view of the preferred embodiment of the invention, taken transversely to the elevation view of FIG. 2, showing the magnetic structure in a first position.
Figure 3B:
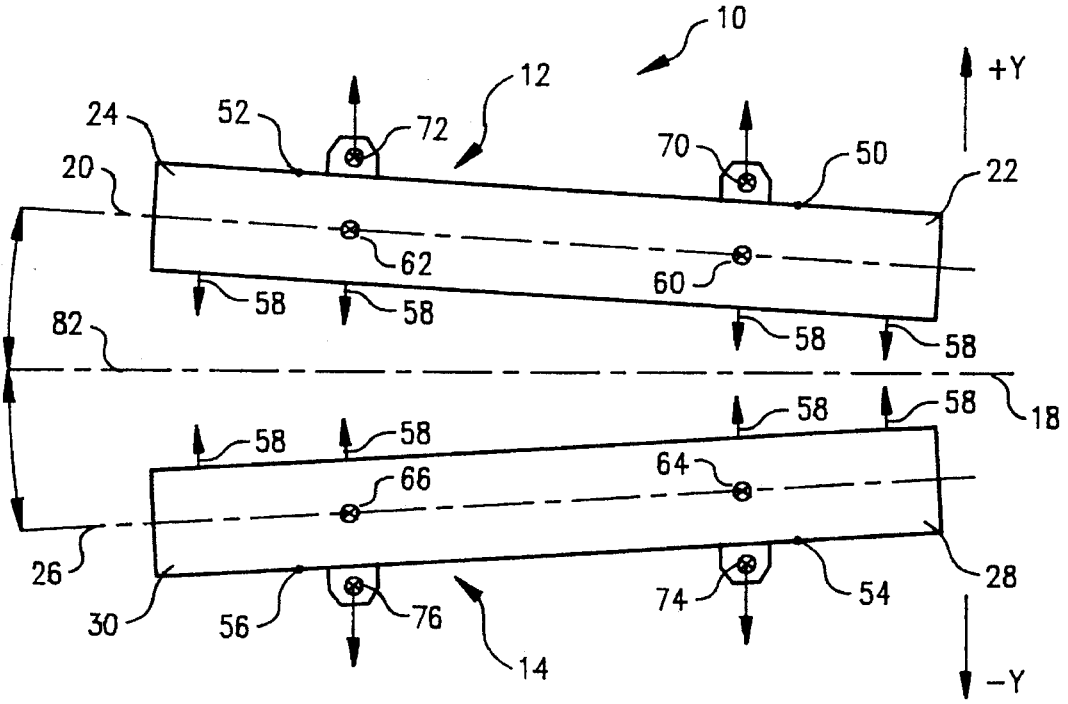
FIG. 3B is an elevation view of the preferred embodiment of the invention, taken transversely to the elevation view of FIG. 2, showing the magnetic structure in a second position.

FIG. 1 is a perspective view of the preferred embodiment of the invention. FIG. 2 is an elevation view of the preferred embodiment of the invention, taken in the longitudinal direction along the preferred embodiment. Also, FIG. 3A is an elevation view of the preferred embodiment of the invention, taken transversely to the elevation view of FIG. 2, showing the magnetic structure in a first position. Further, FIG. 3B is an elevation view of the preferred embodiment of the invention, taken transversely to the elevation view of FIG. 2, showing the magnetic structure in a second position.

A magnet structure 10 includes a first magnet structure 12, a second magnet structure 14, and an adjustment mechanism 16. The first magnet structure 12 is placed on one side of a first plane 18 and the second magnet structure 14 is placed on the other side of the first plane 18. The first magnet structure 12 is longitudinal and has a first longitudinal axis 20 associated therewith. The first magnet structure 12 also has a first end 22 and a second end 24 disposed along the first magnet structure 12 relative to the first longitudinal axis 20. The first end 22 is placed adjacent an upstream end and the second end 24 is placed adjacent a downstream end of a charged particle beam.

The first magnet structure 12 includes a first array of magnets that are placed on a portion of the magnet structure 12 that is directed toward the first plane 18. Although the first array of magnets is most typically a linear array of magnets, the first array of magnets could also be a two-dimensional array of magnets. In some cases the magnets in the first array of magnets can have pole pieces (such as are known in the prior art) placed therebetween.

The second magnet structure 14 (shown only in partial view in FIG. 1) is also longitudinal and has a second longitudinal axis 26 associated therewith. The second magnet structure 14 also has a first end 28 and a second end 30 (not shown for clarity in FIG. 1) disposed along the second magnet structure 14 relative to the second longitudinal axis 26.

The second magnet structure 14 also includes a second array of magnets that are placed on a portion of the magnet structure 14 that is directed toward the first plane 18. Although the array of magnets is preferably a linear array of magnets, the array of magnets could also be a two-dimensional array of magnets. Most typically the magnets in the array of magnets are permanent magnets, although they could be electromagnets which are energized at appropriate times and with appropriate magnitude to accomplish the purpose desired for the magnet structure 10. In some cases the magnets can have pole pieces (such as are known in the prior art) placed therebetween. Although preferably the first plane 18 is horizontal, it could also be vertical or any other desired angular orientation by rotation of the entire magnet structure 10.

The individual magnets included in the array of magnets that is contained in the first magnet structure 12 can substantially line up with individual magnets included in the array of magnets that is contained in the second magnet structure 14. Further, in the preferred embodiments, the magnets in the arrays of magnets that are contained in the first and second magnet structures 12 and 14 have planar surfaces that are directed toward the first plane 18 and are also substantially parallel to the first plane 18. The first ends 22 and 28 of the respective first and second magnet structures 12 and 14 are both located on the same side of a second plane 31 that is substantially mutually perpendicular to the first plane 18 and to the plane containing both of the first and second longitudinal axes 20 and 26. In one preferred embodiment, the respective first ends 22 and 28 of the first and second magnet structures 12 and 14 are aligned with the second plane 31.

The adjustment mechanism 16 includes a first linear bearing 30 and a second linear bearing 32, both attached to the first magnet structure 12, and is shown schematically in FIG. 1. The adjustment mechanism 16 also includes a third linear bearing 34 and a fourth linear bearing 36, both attached to the second magnet structure 14, and is also shown schematically in FIG. 1.

Each of the linear bearings 30, 32, 34, and 36 also includes a respective first link $\mathbf{38_1}$, $\mathbf{40_1}$, $\mathbf{42_1}$, and $\mathbf{44_1}$, and a respective second link $\mathbf{38_2}$, $\mathbf{40_2}$, $\mathbf{42_2}$, and $\mathbf{44_2}$. The respective first links $\mathbf{38_1}$, $\mathbf{40_1}$, $\mathbf{42_1}$, and $\mathbf{44_1}$ are fixed in length. The lengths of the respective second links $\mathbf{38_2}$, $\mathbf{40_2}$, $\mathbf{42_2}$, and $\mathbf{44_2}$ are adjustable.

The first magnet structure 12 is supported at points 50 and 52. Similarly, the second magnet structure 14 is supported at points 54 and 56 (not shown in FIG. 1). Typically the support at points 50, 52, 54 and 56 is provided by lifting screws for at least two reasons. One reason is to effectively oppose the attractive or repulsive forces 58 between the first and second magnetic structures 12 and 14 in the third plane 80. The other reason is to move the structure relative to the first plane 18.

The first magnet structure 12 also includes first and second conventional spherical bearings 60 and 62, such as spherical couplings made by Magnaloy Coupling Company, of Alpena, Mich. 49707. Similarly, the second magnet structure 14 also includes third and fourth conventional spherical bearings 64 and 66 (not shown in FIG. 1). The first link $\mathbf{38_1}$ is attached between the linear bearing 30 and the spherical bearing 60, and the first link $\mathbf{40_1}$ is attached between the second linear bearing 32 and the spherical bearing 62. Similarly, the first link $\mathbf{42_1}$ is attached between the third linear bearing 34 and the spherical bearing 64, and the first link $\mathbf{44_1}$ is attached between the fourth linear bearing 36 and the spherical bearing 66.

Further, the first magnet structure 12 includes fifth and sixth conventional spherical bearings 70 and 72. Similarly, the second magnet structure 14 also includes seventh and eighth conventional spherical bearings 74 and 76 (not shown in FIG. 1). The spherical bearings 60, 62, 70 and 72 are all coplanar. They lie in a third plane 80 that is mutually perpendicular to the first plane 18 and the second plane 31. Accordingly, the magnet arrays in the first and second magnet structures 12 and 14 lie substantially in the third plane 80. The intersection of the third plane 80 with the first plane 18 defines a third longitudinal axis 82. The third longitudinal axis 82 is approximately the position of the path that electrons follow as they pass through the magnet structure 10.

Each of the linear bearings 30, 32, 34 and 36 includes a respective fixed rail 90, 92, 94 and 96 attached to a conventional overall support structure 130 (shown schematically in FIG. 2). The support structure 130 is typically made from a material with at most a low magnetic permeability, such as aluminum. In addition to two vertical supports such as support 132 displaced longitudinally and which support the magnet structure 10 over the ground 134, the support structure 130 may also include two conventional horizontal beams or other conventional rigidizing structures that connect longitudinally between the two vertical supports 132. Alternatively, the support structure 130 can include conventional retractable wheels which allow the magnetic structure 10 to be moved over the ground 134. Contained within the vertical supports 132 are a conventional stepper or synchronous motor (not shown) which is connected to the input of a conventional Cone Drive gear box (also not shown), made by Cone Drive Operations Inc. of Traverse City, Mich. The output of the conventional Cone Drive gear box is the connected to carriages (described subsequently) of one or both of the linear bearings associated with the particular vertical support 132 housing the motor and gear box. The stepper motor can be made by the Superior Motor Co., of Bristol, Conn.

Attached to each of the fixed rails 90, 92, 94 and 96 are respective carriages 100, 102, 104 and 106. Each of the carriages 100, 102, 104 and 106 can move independently of the other carriages through the action of the stepper motor(s) and Cone Drive gear box(es) described above on conventional lead screws (not shown) that are made part of the respective carriages in accordance with practices well-known to those skilled in the art. The connections between the fixed length first links $\mathbf{38}_1$ and $\mathbf{40}_1$ and the respective carriages 100 and 102 form a hinge that allows rotation of the links in a direction perpendicular to the first plane 18. In combination with adjustment of the adjustable second links $\mathbf{38}_2$ and $\mathbf{40}_2$, the position of each of the spherical bearings 70 and 72 can be changed to set the angle of rotation of the first magnetic structure 12 about the first longitudinal axis 20. In order to maintain the relative positions of the first and second magnetic structures 12 and 14 during a tapering motion (to be described subsequently), the first link $\mathbf{38}_1$ may be completely fixed at its hinge on the linear bearing 30 so as to prevent rotation of the linear bearing 30. This prevents translation of each of the first and second magnetic structures 12 and 14 in the longitudinal direction. Accordingly, the center of rotation of the first and second magnetic structures 12 and 14 parallel to the first plane 18 is fixed at the spherical bearing 60. The fixed link $\mathbf{40}_1$ is left free to rotate about its hinge on the carriage.

As shown in FIG. 3A, under normal operating conditions, the first longitudinal axis 20 and second longitudinal axis 26 of the respective first magnet structure 12 and second magnet structure 14 are parallel to each other and to the third longitudinal axis 82. As shown in FIG. 3B, motion can be applied differentially to the points 50 and 52 of the first magnet structure 12 and also to the points 54 and 56 of the second magnet structure 14. In this case, the distances of travel of the points 50, 52, 54 and 56 perpendicular to the first plane 18 can be unequal, and their relative directions of travel are substantially (but not necessarily exactly) perpendicular to the first plane 18 and substantially (but not necessarily exactly) parallel to each other. In this way, the effective longitudinal distances between the spherical bearing 60 and the spherical bearing 62 and between the spherical bearing 64 and the spherical bearing 66 change. The actual separation of the spherical bearing 60 and the spherical bearing 62 and of the spherical bearing 64 and the spherical bearing 66 cannot change since their support structure is rigid. Accordingly, first link $\mathbf{40}_1$ and second links $\mathbf{38}_2$ and $\mathbf{40}_2$ must rotate about their axes perpendicular to first plane 18 in order to accommodate this foreshortening without imparting any additional constraint on the magnetic structures.

While the foregoing is a detailed description of the preferred embodiment of the invention, there are many alternative embodiments of the invention that would occur to those skilled in the art and which are within the scope of the present invention. Accordingly, the present invention is to be determined by the following claims.

We claim:

1. An apparatus for adjusting the spacing of the elements of a magnetic structure including a first array of magnets and a second array of magnets, the first and second arrays of magnets each having a first end and a second end, being arranged on first and second sides of a first plane, the first ends of the first and second arrays of magnets being aligned with a first side of a second plane that is perpendicular to the first plane, the first and second arrays of magnets extending away from the first side of the second plane, the apparatus comprising:

a first spacing adjuster connected between the first ends of the first and second arrays of magnets and extending substantially perpendicularly to the first plane; and a second spacing adjuster connected between the second ends of the first and second arrays of magnets and extending substantially perpendicularly to the first plane, the first spacing adjuster being adapted to adjust the spacing between the first ends of the first and second arrays of magnets in a first direction perpendicular to the first plane, and the second spacing adjuster being adapted to adjust the spacing between the second ends of the first and second arrays of magnets in a second direction perpendicular to the first plane, whereby the spatial relationships between the first ends of the first and second arrays of magnets and between the second ends of the first and second arrays of magnets are independently adjustable.

2. The apparatus of claim 1 wherein at least one of the first and second arrays of magnets is a linear array.

3. The apparatus of claim 1 wherein both of the first and second arrays of magnets are linear arrays that are substantially coplanar in a third plane that is mutually perpendicular to the first and second planes.

4. The apparatus of claim 3 wherein each magnet in the first and second arrays of magnets is aligned with a distinct one of the magnets in the other array.

5. The apparatus of claim 3 wherein each magnet in the first and second arrays of magnets has a planar face that is individually parallel to the first plane.

6. The apparatus of claim 3 wherein the consecutive magnets in both of the first and second arrays of magnets are separated by consecutive pole pieces.

7. The apparatus of claim 3 wherein the intersection of the first and third planes defines an axis and the spatial relationships between the axis and the first and second ends of both of the first and second arrays of magnets are independently adjustable.

8. The apparatus of claim 1 wherein both of the first and second arrays of magnets are two-dimensional arrays that are substantially coplanar in a third plane that is mutually perpendicular to the first and second planes.

9. The apparatus of claim 8 wherein each magnet in the first and second arrays of magnets is aligned with a distinct one of the magnets in the other array.

10. The apparatus of claim 9 wherein each magnet in the first and second arrays of magnets has a planar face that is individually parallel to the first plane.

11. The apparatus of claim 8 wherein the intersection of the first and third planes defines an axis and the spatial relationships between the axis and the first and second ends of both of the first and second arrays of magnets are independently adjustable.

12. The apparatus of claim 1 wherein the first ends of the first and second arrays of magnets are fixed relative to the second plane.

13. The apparatus of claim 12 wherein each magnet in the first and second arrays of magnets is aligned with a distinct one of the magnets in the other array.

14. The apparatus of claim 12 wherein each magnet in the first and second arrays of magnets has a planar face that is individually parallel to the first plane.

15. The apparatus of claim 1, further comprising a support structure connected to both the first spacing adjuster and the second spacing adjuster.

16. A method for adjusting the spacing of the elements of a magnetic structure including a first array of magnets and a second array of magnets, the first and second arrays of magnets each having a first end and a second end, being arranged on first and second sides of a first plane, the first ends of the first and second arrays of magnets being aligned with the same side of a second plane that is perpendicular to the first plane, the first and second arrays of magnets extending away from the same side of the second plane, the method comprising the steps of:

a) connecting a first spacing adjuster between the first ends of the first and second arrays of magnets, the first spacing adjuster extending substantially perpendicularly to the first plane; and b) connecting a second spacing adjuster between the second ends of the first and second arrays of magnets, the second spacing adjuster extending substantially perpendicularly to the first plane, the first spacing adjuster being adapted to adjust the spacing between the first ends of the first and second arrays of magnets in a first direction perpendicular to the first plane, and the second spacing adjuster being adapted to adjust the spacing between the second ends of the first and second arrays of magnets in a second direction perpendicular to the first plane, whereby the spatial relationships between the first ends of the first and second arrays of magnets and between the second ends of the first and second arrays of magnets are independently adjustable.

17. The method of claim 16 wherein at least one of the first and second arrays of magnets is a linear array.

18. The method of claim 16 wherein both of the first and second arrays of magnets are linear arrays that are substantially coplanar in a third plane that is mutually perpendicular to the first and second planes.

19. The method of claim 18 wherein the intersection of the first and third planes defines an axis and the spatial relationships between the axis and the first and second ends of both of the first and second arrays of magnets are independently adjustable.

20. The method of claim 16 wherein the first ends of the first and second arrays of magnets are fixed relative to the second plane.

21. The method of claim 16, further comprising the step of connecting the first spacing adjuster and the second spacing adjuster to a support structure.

22. An apparatus for adjusting the spacing of the elements of a magnetic structure including a first array of magnets and a second array of magnets, the first and second arrays of magnets each having a first end and a second end, being arranged on first and second sides of a first plane, the first ends of the first and second arrays of magnets being aligned with the same side of a second plane that is perpendicular to the first plane, the first and second arrays of magnets extending away from the same side of the second plane, the apparatus comprising:

adjustment means connected between the first ends of the first and second arrays of magnets and extending substantially perpendicularly to the first plane for adjusting the spacing between the first ends of the first and second arrays of magnets; and second adjustment means connected between the second ends of the first and second arrays of magnets and extending substantially perpendicularly to the first plane for adjusting the spacing between the second ends of the first and second arrays of magnets, the first adjustment means being adapted to adjust the spacing between the first ends of the first and second arrays of magnets in a first direction perpendicular to the first plane, and the second adjustment means being adapted to adjust the spacing between the second ends of the first and second arrays of magnets in a second direction perpendicular to the first plane, whereby the spatial relationships between the first ends of the first and second arrays of magnets and between the second ends of the first and second arrays of magnets are independently adjustable.

23. The apparatus of claim 22 wherein at least one of the first and second arrays of magnets is a linear array.

24. The apparatus of claim 22 wherein both of the first and second arrays of magnets are linear arrays that are substantially coplanar in a third plane that is mutually perpendicular to the first and second planes.

25. The apparatus of claim 24 wherein each magnet in the first and second arrays of magnets is aligned with a distinct one of the magnets in the other array.

26. The apparatus of claim 24 wherein each magnet in the first and second arrays of magnets has a planar face that is individually parallel to the first plane.

27. The apparatus of claim 24 wherein the consecutive magnets in both of the first and second arrays of magnets are separated by consecutive pole pieces.

28. The apparatus of claim 24 wherein the intersection of the first and third planes defines an axis and the spatial relationships between the axis and the first and second ends of both of the first and second arrays of magnets are independently adjustable.

29. The apparatus of claim 22 wherein both of the first and second arrays of magnets are two-dimensional arrays that are substantially coplanar in a third plane that is mutually perpendicular to the first and second planes.

30. The apparatus of claim 29 wherein each magnet in the first and second arrays of magnets is aligned with a distinct one of the magnets in the other array.

31. The apparatus of claim 30 wherein each magnet in the first and second arrays of magnets has a planar face that is individually parallel to the first plane.

32. The apparatus of claim 29 wherein the intersection of the first and third planes defines an axis and the spatial relationships between the axis and the first and second ends of both of the first and second arrays of magnets are independently adjustable.

33. The apparatus of claim 22 wherein the first ends of the first and second arrays of magnets are fixed relative to the second plane.

34. The apparatus of claim 33 wherein each magnet in the first and second arrays of magnets is aligned with a distinct one of the magnets in the other array.

35. The apparatus of claim 33 wherein each magnet in the first and second arrays of magnets has a planar face that is individually parallel to the first plane.

36. The method of claim 35 wherein the first ends of the first and second arrays of magnets are fixed relative to the second plane.

37. The apparatus of claim 24, further comprising a support structure connected to both the first adjustment means and the second adjustment means.

* * * * *